US010233595B2

(12) United States Patent
Zhou

(10) Patent No.: US 10,233,595 B2
(45) Date of Patent: Mar. 19, 2019

(54) HARD PAVEMENT CONSTRUCTION METHOD FOR NATURAL GROUNDWATER RECHARGE

(71) Applicant: Taize Zhou, Shantou (CN)

(72) Inventor: Taize Zhou, Shantou (CN)

( * ) Notice: Subject to any disclaimer, the term of this patent is extended or adjusted under 35 U.S.C. 154(b) by 0 days.

(21) Appl. No.: 15/697,450

(22) Filed: Sep. 7, 2017

(65) Prior Publication Data

US 2017/0362779 A1 Dec. 21, 2017

Related U.S. Application Data

(63) Continuation of application No. PCT/CN2016/000121, filed on Mar. 9, 2016.

(30) Foreign Application Priority Data

Mar. 12, 2015 (CN) ..... 2015 1 0116269

(51) Int. Cl.
*E01C 5/00* (2006.01)
*E01C 5/08* (2006.01)
(Continued)

(52) U.S. Cl.
CPC ..... *E01C 5/08* (2013.01); *E01C 3/00* (2013.01); *E01C 3/06* (2013.01); *E01C 5/003* (2013.01);
(Continued)

(58) Field of Classification Search
CPC ... E01C 5/003; E01C 5/04; E01C 5/08; E01C 5/22; E01C 3/00; E01C 3/06; E01C 5/00
(Continued)

(56) References Cited

U.S. PATENT DOCUMENTS 1,606,990 A * 11/1926 Funk ..... E02B 11/00 405/42
3,837,168 A * 9/1974 Alsberg ..... E01F 5/00 404/4
(Continued)

FOREIGN PATENT DOCUMENTS

CN 101024936 A 8/2007
CN 200981968 Y 11/2007
(Continued)

*Primary Examiner* — Raymond W Addie
(74) *Attorney, Agent, or Firm* — Wayne & Ken, LLC; Tony Hom

(57) ABSTRACT

A hard pavement construction method for natural groundwater recharge, comprising the following steps: drilling to an underground shallow sand zone water storage layer on a flattened earth floor, filling holes with sand, inserting rod-shaped tools into the holes filled with the sand, pouring concrete to form a concrete foundation layer with a flat surface, removing the rod-shaped tools, filling the holes with the sand to be flush with a plane of the concrete foundation layer, sanding and compacting on the concrete foundation layer, directly arranging pavement bricks on a sand surface in an unbonded manner to form a hard pavement, and enabling rain and snow water on the hard pavement to pass through cracks of the pavement bricks, rapidly and naturally recharge to the underground shallow sand zone water storage layer via the holes and slowly permeate to an underground deep sand zone water storage layer.

6 Claims, 7 Drawing Sheets

(51) Int. Cl.
*E01C 5/04* (2006.01)
*E01C 3/00* (2006.01)
*E01C 3/06* (2006.01)
*E01C 5/22* (2006.01)

(52) U.S. Cl.
CPC ..... *E01C 5/04* (2013.01); *E01C 5/00* (2013.01); *E01C 5/22* (2013.01)

(58) Field of Classification Search
USPC ..... 404/17, 28, 27, 31, 34–36, 72
See application file for complete search history.

(56) References Cited

U.S. PATENT DOCUMENTS 4,199,272 A * 4/1980 Lacey ..... E03B 3/15 166/51
4,523,755 A * 6/1985 Turba ..... C04B 28/04 106/720
5,746,544 A * 5/1998 Baghoomian ..... E01C 3/006 404/43
6,206,607 B1 * 3/2001 Medico, Jr. ..... E01C 5/18 404/2
7,244,076 B2 * 7/2007 Whitson ..... E01C 1/00 404/34
7,686,540 B2 * 3/2010 Urriola ..... E01C 11/225 405/43
7,879,921 B2 * 2/2011 Cummins ..... C08L 33/066 521/64
8,834,060 B2 * 9/2014 Lawry ..... A01G 29/00 404/4
2008/0019770 A1 * 1/2008 Shaw ..... E01C 11/226 404/2
2009/0067925 A1 * 3/2009 Kaul ..... E01C 3/06 404/17
2009/0214296 A1 8/2009 Shaw
2010/0150654 A1 * 6/2010 Shaw ..... E01C 11/18 405/50
2011/0064517 A1 * 3/2011 Sader ..... E01C 7/142 404/28

FOREIGN PATENT DOCUMENTS

CN 201843042 U 5/2011
CN 202099866 U 1/2012
CN 202164521 U 3/2012
CN 202718027 U 2/2013
CN 104278608 A 1/2015
CN 104846712 A 8/2015
JP 2003119712 A 4/2003
JP 2007107258 A 4/2007
JP 2012046981 A 3/2012
WO 2011049253 A1 4/2011

* cited by examiner

HARD PAVEMENT CONSTRUCTION METHOD FOR NATURAL GROUNDWATER RECHARGE

TECHNICAL FIELD

The present invention relates to a hard pavement construction method for natural groundwater recharge on a watertight concrete foundation layer, and particularly relates to a hard pavement construction method capable of enabling natural rainfall to rapidly recharge to an underground shallow sand zone water storage layer and further be naturally filtered and permeated to an underground deep sand zone water storage layer through a clay layer.

BACKGROUND

At present, for a known hard pavement construction method for urban roads, squares and residential areas, concrete pouring and bonding is mostly used, and surface water is completely isolated from groundwater; permeable holes are reserved through concrete pouring, so that pavement water can slowly permeate to a surface soil layer through the holes; however, a water permeation effect is extremely poor, a natural recharge rate of rainwater is extremely low, a slightly great rainfall may cause surface gathered water, and natural water cannot rapidly recharge underground; a pervious concrete and pervious asphalt construction method is also used, while water permeability retention time is short, a phenomenon that water permeation holes are often blocked after construction within several months occurs, and construction cost is high; and further, a permeable cement brick laying method is used, and since permeable cement bricks are coarse in grain, poor in bonding fastness, low in pressure resistance and easy to break, and due to closure property of foundation treatment, the permeable cement bricks have limited water absorbing capacity, and gathered water is still caused when a heavy rain appears. A large-area pavement gathered water problem on hard pavements similar to the urban roads, the squares and the residential areas is still a worldwide problem. Particularly important, an underground water level is gradually declined, and a framework role of water in soil is gradually lost. In order to enable city underground to have a sponge-like water absorption function, manners of digging to form ponds, implementing underground water storage projects and the like are adopted in the prior art, causing that construction cost is extremely high, territorial resources are wasted, stagnant ponds are often formed, maintenance cost is high, an environmental beautification degree is low, and even the ponds become stinking ditches influencing the environment.

SUMMARY

The present invention provides a hard pavement construction method for natural groundwater recharge in order to realize the following purposes that gathered water does not exist on large-area hard pavements of urban roads, squares and residential areas and the like on rainy days, natural rainfall can rapidly recharge to an underground shallow sand zone water storage layer and be naturally filtered and permeated to an underground deep sand zone water storage layer through a clay layer, groundwater is effectively supplemented, a groundwater pollution problem caused by artificial direct recharge of a deep groundwater layer is avoided, pedestrians can walk on the pavement while automobiles and other heavy means of transportation can run and be parked on the pavement, and a "sponge city" is really realized rapidly at low price and high efficiency so that urban and rural lands made from concrete have a natural water underground recharge effect of mountains, rivers, lakes, seas, fields and forests.

A solution for solving technical problems in the present invention is as follows: in an industrial under-development period in the past, a well is dug underground by several meters to reach the shallow sand zone water storage layer when groundwater is abundant, thereby obtaining high-quality groundwater. But nowadays, particularly in a city, a well is often dug by dozens of meters and even several hundred meters, so as to obtain an ideal groundwater source. A soil structure is in vein belt distribution and includes several layers of various clay zones and a layer of sand zone from ground to underground. The sand zone is an optimal water storage layer and also an optimal diversion layer of water, so a water getting source of the dug well must be on the sand zone layer. Along with exhaustion of groundwater resources, the sand zones are penetrated to perform deep digging one after another for getting water. According to this theory, the natural rainfall on the ground can be guided to the underground shallow sand zone layer through a manner of filling holes with sand, so that a drainage speed is high, construction cost is low, and natural groundwater permeation and recharge are reasonably guided and accelerated. The above method is a core content and a technical innovation for solving hard pavement drainage and natural groundwater recharge in the present invention. A specific solution is as follows: holes are drilled orderly or disorderly on a flattened earth floor to reach a sand zone layer at a proper underground depth or a sand zone layer which penetrates through multiple shallow sand zone water storage layers, is once stored with water or still contains water now, and a thickness and sand grains of the sand zone layer are enough for water storage and diversion. A hole diameter of the drilled hole is 5-100 cm, a hole distance is 0.5-20 m, and the hole is filled with sand. A size and a depth of the hole shall be favorable for drainage and cost minimization, and the larger the hole is, the more the consumed manual labor is, and the more the filled sand is. The drilled hole is filled with sand to reach the earth floor; a circular stick or a stick of any shape or a rod-shaped tool of other materials is inserted into the hole filled with the sand on the basis of filling the hole with the sand; and the rod-shaped tool is removed after concrete is poured, thereby forming a concrete foundation layer with a flat surface in which holes are distributed. More drainage holes are favorable for drainage of the pavement after completion. A thickness of the concrete foundation layer can be determined according to bearing gravity used by the pavement. The holes are continuously filled with the sand to reach a plane of the concrete foundation layer, and a sand layer with a thickness of 2-30 cm is laid on the concrete foundation layer. The sand layer performs effects of absorbing water, guiding water and absorbing a pressure of pavement bricks, a thickness of the sand layer can be determined according to precipitation, and due to large rainfall at a time and frequent rainfall, the thickness of the sand layer is relatively larger. The pavement bricks are directly arranged on a surface of the sand layer orderly or disorderly in an unbonded layer to form the hard pavement, a crack of every two pavement bricks is 1-50 mm, the cracks are filled with sand, water is injected densely, rain and snow water on the hard pavement passes through cracks of the pavement bricks and naturally recharges to the underground shallow sand zone water storage layer via the holes, and the natural rain and snow water is rapidly and temporarily stored through one or more underground shallow sand zone layers and then slowly permeates to the deep sand zone water storage layer through the clay layer, thereby supplementing the underground water source. The concrete foundation layer, the sand and the pavement bricks are fixed on an edge of the hard pavement by using gravel, so that natural displacement and loss of the pavement can be avoided. A drainage channel which is 1-5 cm lower than the pavement bricks is made on an inner side of the gravel on the edge of the hard pavement, so that the gathered water which cannot be rapidly and naturally recharged to the underground shallow sand zone water storage layer is drained into a rainwater well, so that the drainage channel serves as a standby drainage canal under a condition that the drainage holes cannot meet drainage when the rainfall is large.

The present invention has benefits as follows: the natural rainfall rapidly recharges to the underground shallow sand zone water storage layer and is further naturally filtered and slowly permeated to the underground deep sand zone water storage layer through a soil layer on basis of ensuring road bearing capacity. When the construction method in the present invention is used for constructing urban and rural hard pavements in a large area, important environmental protection problems that natural groundwater recharge cannot be realized and city settlement cannot be retarded are effectively solved, and a groundwater pollution problem caused by artificial direct deep groundwater recharge can be avoided. Meanwhile, a prefabricated member does not need to be manufactured in the present invention, thereby decreasing manual loss and energy consumption. A high-efficiency low-cost environmental-friendly and energy-saving urban and rural hard pavement construction innovation mode is an optimal construction mode for complying with nature and realizing a sponge city.

BRIEF DESCRIPTION OF DRAWINGS

The present invention is further described below in combination with drawings and embodiments.

In the figures: (1) flattened earth floor; (2) hole; (3) sand; (4) rod-shaped tool; (5) concrete foundation layer; (6) pavement brick crack; (7) pavement brick; (8) gravel; (9) drainage channel; (10) rainwater well; (11) shallow soil layer; (12) shallow sand zone water storage layer; (13) clay layer; and (14) deep sand zone water storage layer.

DETAILED DESCRIPTION

Figure 1:
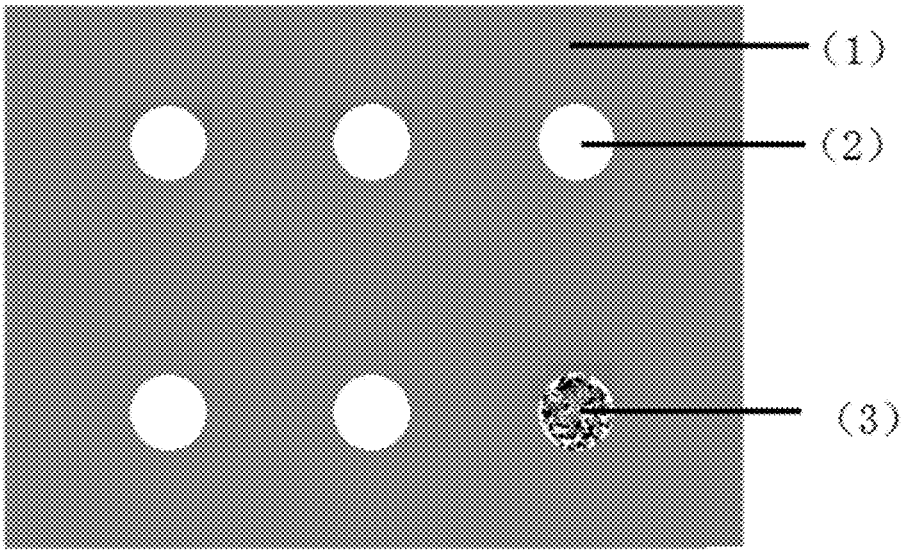
FIG. 1 is a top view for drilling on a flattened earth floor to form holes and filling sand.
Figure 2:
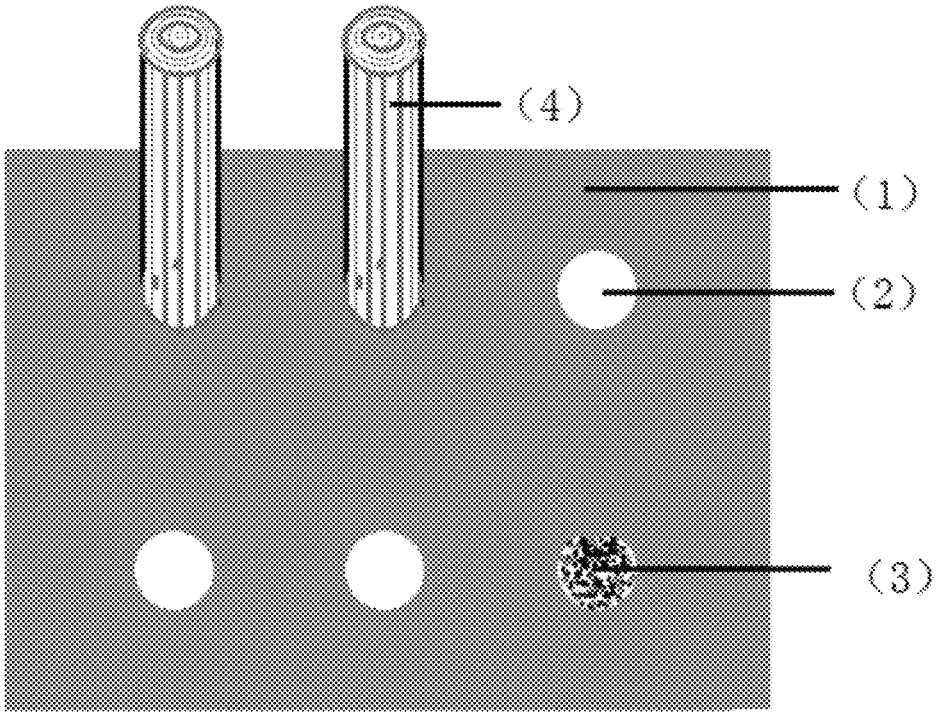
FIG. 2 is a top view for filling holes with sand and inserting a rod-shaped tool.

FIG. 1 and FIG. 2 show preferred embodiments: a flattened earth floor (1) is drilled underground to form holes (2), sand (3) is filled, and a rod-shaped tool (4) is inserted.

Figure 3:
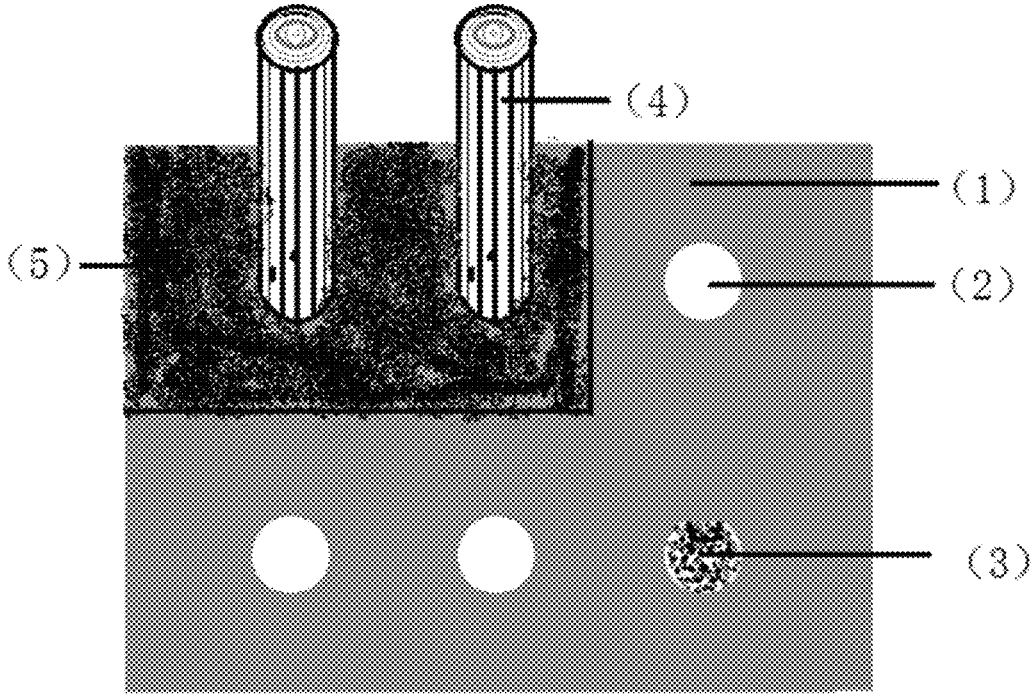
FIG. 3 is top view of a poured concrete foundation layer.
Figure 4:
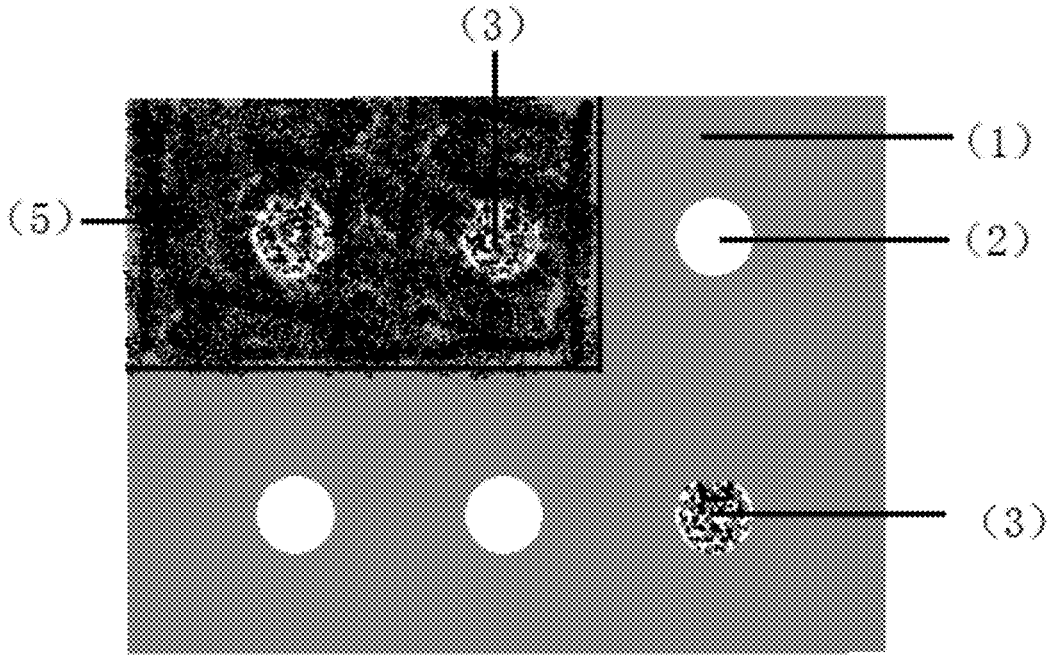
FIG. 4 is a top view for removing a rod-shaped tool and filling holes with sand.

As shown in FIG. 3 and FIG. 4, after concrete is poured, a concrete foundation layer (5) is formed, the rod-shaped tool (4) is removed, the holes (2) are formed, the sand (3) is filled, and water is injected densely.

Figure 5:
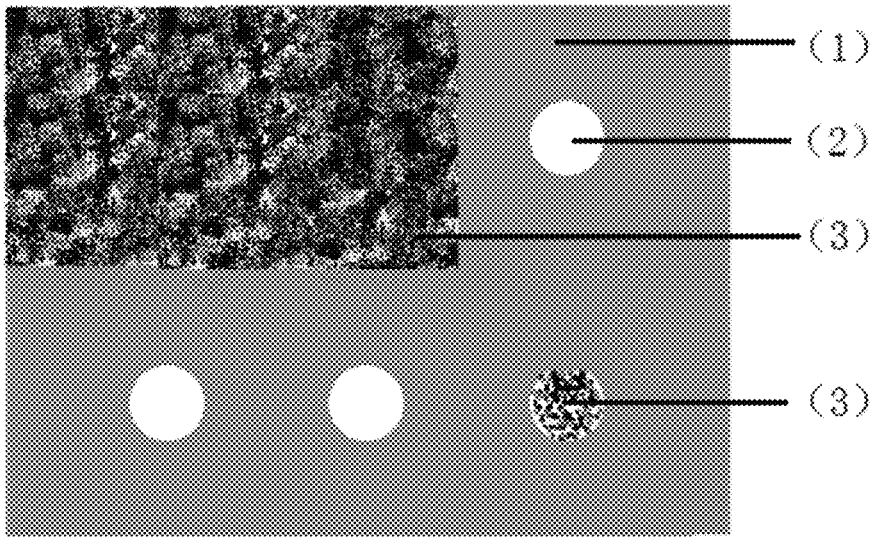
FIG. 5 is a top view for laying sand on a concrete foundation layer.
Figure 6:
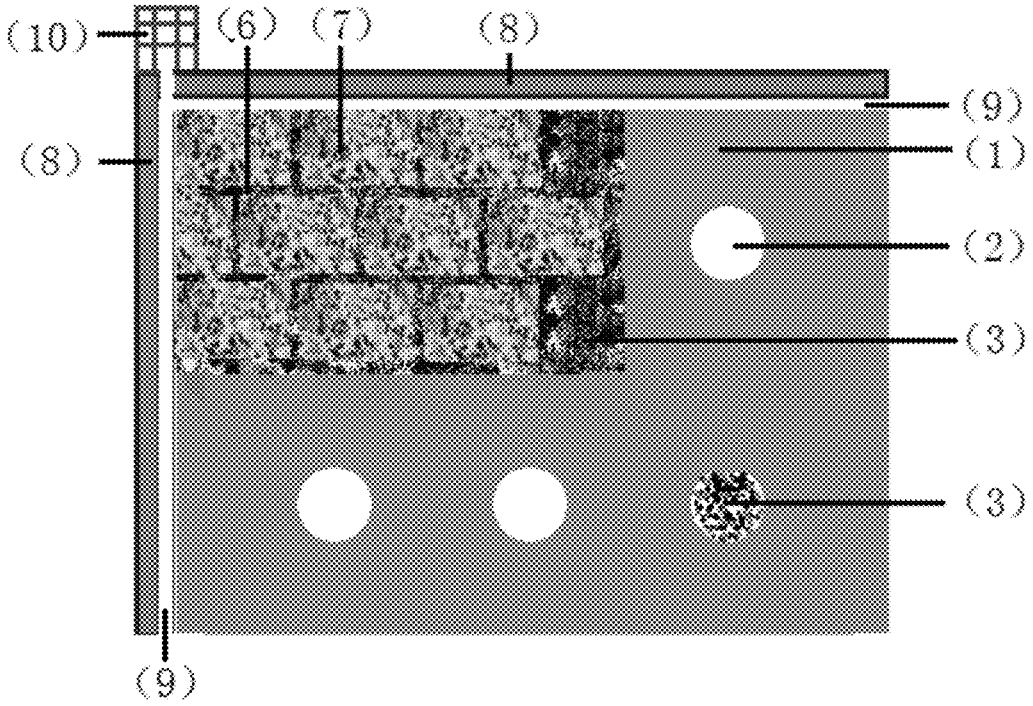
FIG. 6 is a top view of laid pavement bricks, gravel and a drainage channel.

In FIG. 5 and FIG. 6, the sand (3) is laid on a plane of the concrete foundation layer (5), water is injected densely, pavement bricks (7) are orderly arranged on a horizontal plane, pavement brick cracks (6) among the pavement bricks (7) are filled with the sand (3), and water is injected densely to form a hard pavement. The concrete foundation layer (5), the sand (3) and the pavement bricks (7) are fixed by gravel (8) on an edge of the hard pavement, and a drainage channel (9) is formed on an inner side of the gravel (8), so that gathered water with super-leakage capacity can be drained into a rainwater well (10).

Figure 7:
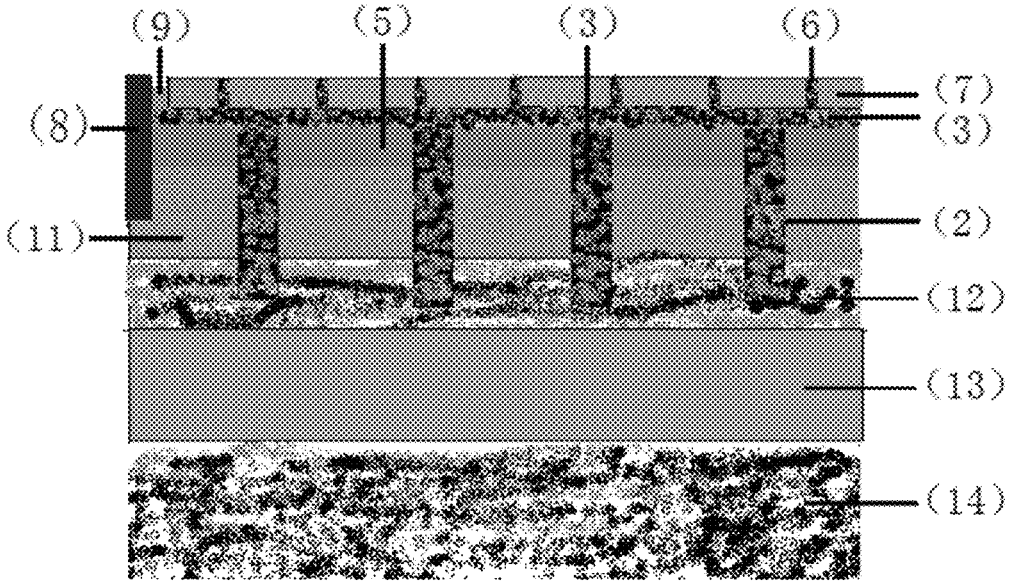
FIG. 7 is a structural sectional view from pavement bricks to groundwater layer.

As shown in FIG. 7, rainwater on the hard pavement rapidly leaks to the shallow soil layer (11) and the shallow sand zone water storage layer (12) through the pavement brick cracks (6) among the pavement bricks (7) via the holes (2), is filtered by a clay layer (13) and slowly leaks to a deep sand zone water storage layer (14).

What is claimed is:

1. A hard pavement construction method for natural groundwater recharge, comprising the following steps:

drilling to an underground shallow sand zone water storage layer on a flattened earth floor;

filling holes with sand to the earth floor;

placing rod-shaped tools onto the holes filled with the sand;

pouring concrete to form a concrete foundation layer with a flat surface;

removing the rod-shaped tools;

continuously filling the holes with the sand to be flush with a plane of the concrete foundation layer;

overlaying sand on the concrete foundation layer; wherein a sand layer with a thickness of 2-30 cm is laid on the concrete foundation layer to form a plane;

then directly arranging pavement bricks on the sand layer in an unbonded manner to form a hard pavement;

filling sand into the gaps between the pavement bricks and filling water to compact the sand in the gaps; and rapidly and naturally recharging surface water to the underground shallow sand zone water storage layer via the holes and slowly permeate to an underground deep sand zone water storage layer.

2. The construction method according to claim 1, wherein holes are drilled orderly or disorderly on the flattened earth floor to reach a sand zone layer at a proper underground depth or a sand zone layer which penetrates through multiple shallow sand zone water storage layers; a hole diameter is 5-100 cm; and a hole distance is 0.5-20 m.

3. The construction method according to claim 1, wherein a circular stick or a stick of any shape or a rod-shaped tool of other materials consistent with the drilled holes in shape and size is inserted into the hole filled with the sand; and the rod-shaped tool is removed after the poured concrete foundation layer is dry and hard; and the holes consistent with the holes of the drilled holes in shape and size are formed in the concrete foundation layer.

4. The construction method according to claim 1, wherein the pavement bricks are directly arranged on a surface of the sand layer orderly or disorderly in an unbonded layer to form the hard pavement; a crack of every two pavement bricks is 1-50 mm.

5. The construction method according to claim 1, wherein a concrete foundation layer, the sand and the pavement bricks are fixed on an edge of the hard pavement by using gravel, so that natural displacement and loss of the pavement is avoided.

6. The construction method according to claim 1, wherein a drainage channel which is 1-5 cm lower than the pavement bricks is used on the edge of the hard pavement, so that the gathered water which cannot be rapidly and naturally recharged to the underground shallow sand zone water storage layer is drained into a rainwater well.

* * * * *